US005228634A

United States Patent [19]

Jardis

[11] Patent Number: 5,228,634

[45] Date of Patent: Jul. 20, 1993

[54] ROLL LOADING APPARATUS

[75] Inventor: Alan W. Jardis, West Chicago, Ill.

[73] Assignee: Jardis Industries, Inc., Bensenville, Ill.

[21] Appl. No.: 863,067

[22] Filed: Apr. 3, 1992

[51] Int. Cl.[5] ..... B65H 19/12

[52] U.S. Cl. ..... 242/58.6

[58] Field of Search ..... 242/58.6, 58, 79; 198/803.13, 803.14; 414/911

[56] References Cited

U.S. PATENT DOCUMENTS

| | | | |
|---|---|---|---|
| 527,879 | 10/1984 | Potter | 242/58.6 |
| 1,339,460 | 5/1920 | Langston | 242/58.6 |
| 1,949,238 | 2/1934 | Broadmeyer | 242/58.6 |
| 3,176,928 | 4/1965 | Saunders | 242/58.6 |
| 3,458,185 | 7/1969 | Merrill | 242/58.6 X |
| 4,767,076 | 8/1988 | Tagawa | 242/58.6 |
| 5,121,885 | 6/1992 | Chipman | 242/58.6 X |
| 740,552 2 | 10/1903 | Goss | 242/58.6 |

*Primary Examiner*—Stanley N. Gilreath
*Attorney, Agent, or Firm*—Douglas B. White

[57] ABSTRACT

A novel roll loading mechanism is described which mechanically lifts a roll of web material into an operative position at the roll mounting of the printing press. This is accomplished by use of a dual chain conveyor having supports cantilevered from the chain, and synchronized to lift both ends of the core simultaneously to the printing press mount. This chain drive and the supports are selectively driven in a forward direction to lift the roll, and reversed to lower the roll to the initial pick-up position. A common drive shaft with sprockets to engage the chains is used to provide simultaneous and synchronized drive to the dual chain conveyors. A triangular configuration of the conveyor chain is used which presents an acute angle having its vertex above the press mount to assure secure position of the roll.

4 Claims, 3 Drawing Sheets

ROLL LOADING APPARATUS

BACKGROUND OF THE INVENTION

1. Field of the Invention

The present invention relates generally to printers which utilize a roll supply of web material. More particularly, the invention relates to a mechanism for loading a roll of web material into an operative position for the printer.

2. Description of the Prior Art

Printers which utilize rolls of web material, such as the Goss Community Press line of printers sold by Rockwell International Corp., generally require the roll to be elevated into an operative position for use. And previously this loading of the roll has been done manually. Once the roll has been moved into position near the press, the core is lifted by the operator, one end at a time, into the operative position for the press.

SUMMARY OF THE INVENTION

The present invention employs a novel roll loading mechanism to mechanically lift a roll of web material into the operative position for the printing press. This is accomplished by use of a dual chain drive conveyor having core engaging supports cantilevered from the chain. The dual chains are synchronized to lift both ends of the core simultaneously to the printing press mount. This chain drive and the supports thereon are selectively driven in a forward direction to lift the roll, and lowered back to the initial pick-up position when reversed. A common drive shaft carrying sprockets for engaging the chains is used to provide simultaneous and synchronized drive to the dual chain conveyors. In a further feature, the chain is mounted to exhibit a span of a triangular configuration, having an upper acute angle with its vertex above the printing press mount, wherein the roll core is lifted over the vertex by the chain conveyors to place the roll into the press mount.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
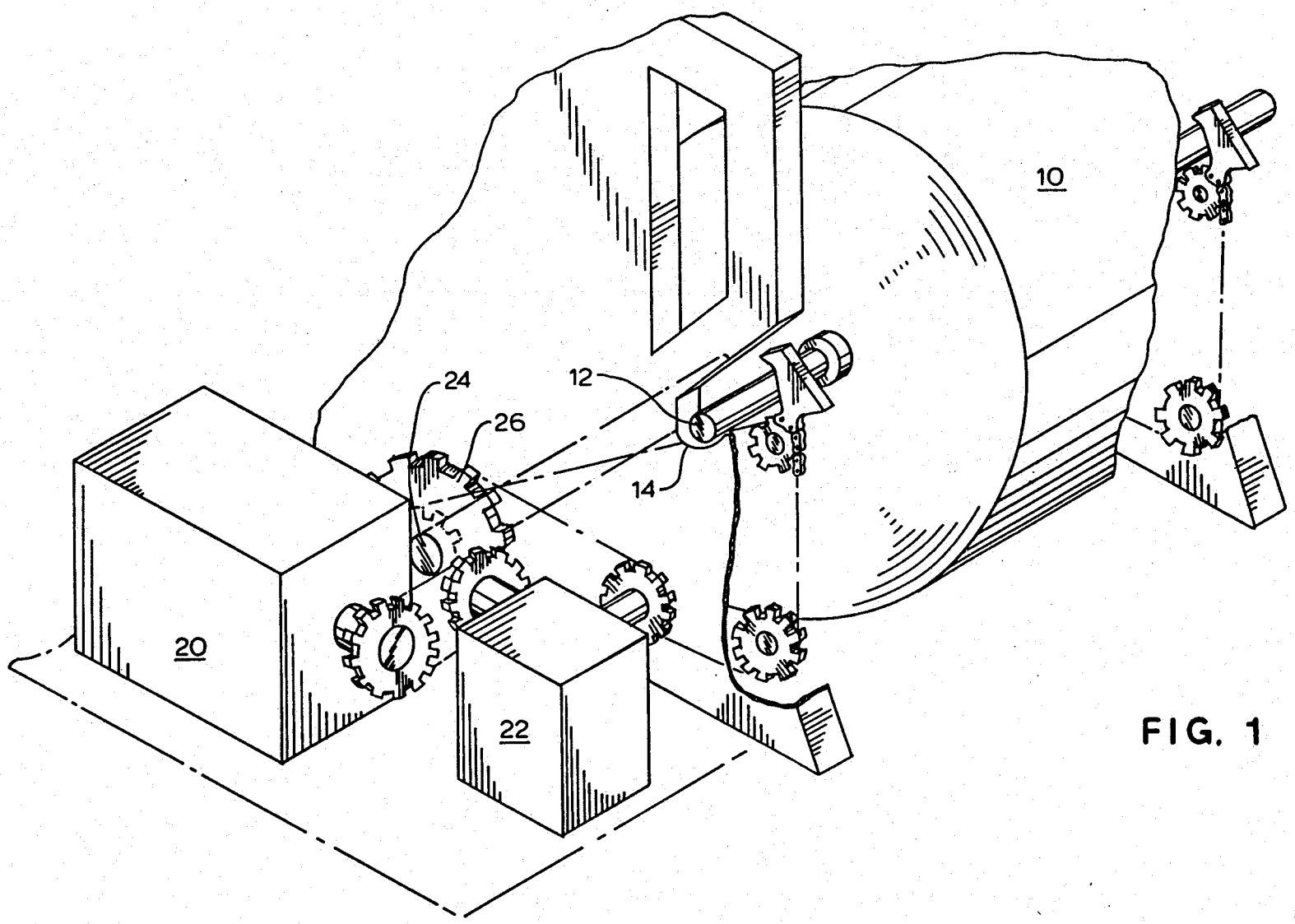
FIG. 1 is a perspective view of the roll loading apparatus of the present invention, shown with a roll of web material loaded into the operative position in the printing press.
Figure 2:
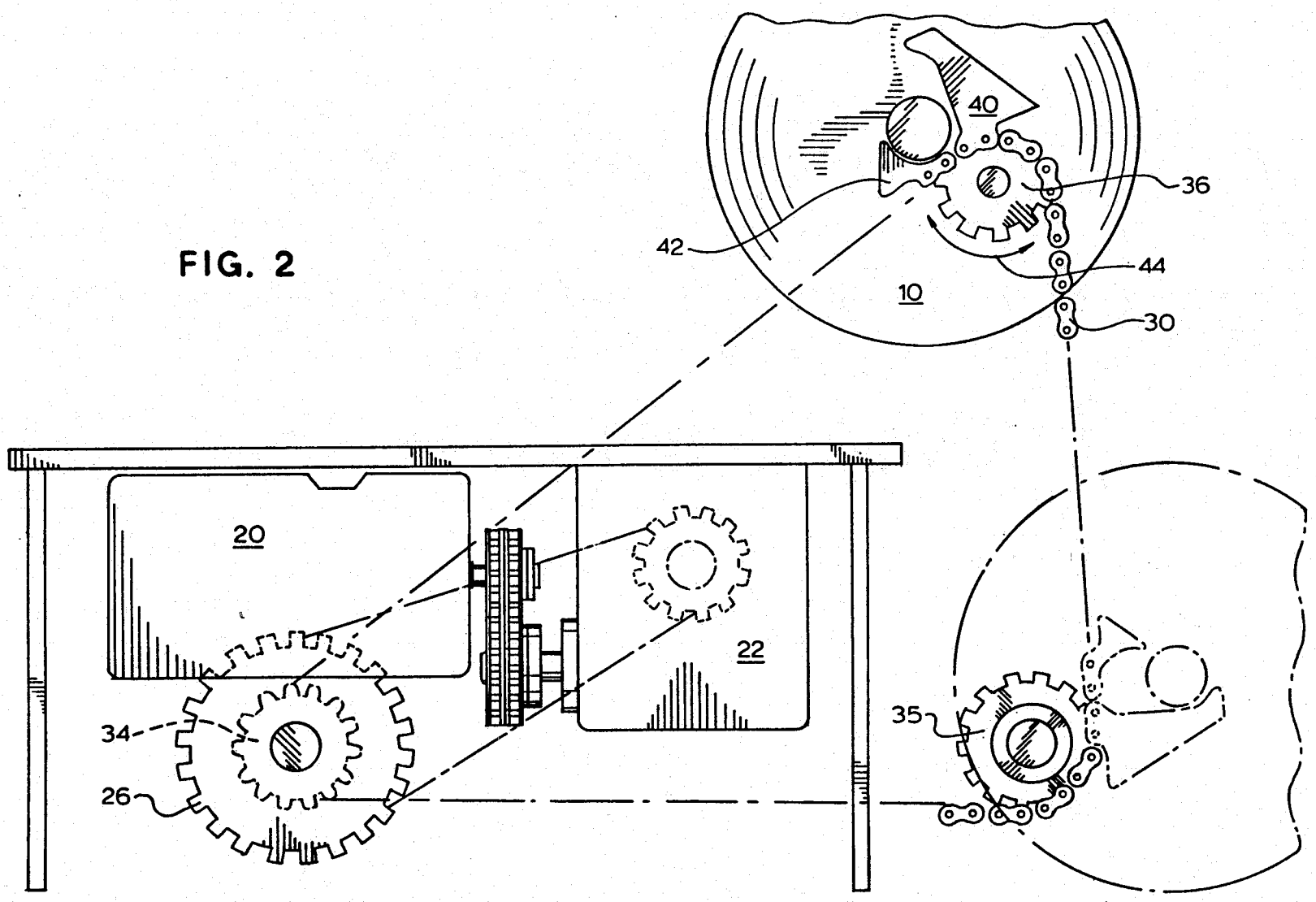
FIG. 2 is a side view of the apparatus of FIG. 1, showing the roll alternatively in both the upper (operative) and in phantom, in the lower (initial) position.
Figure 3:
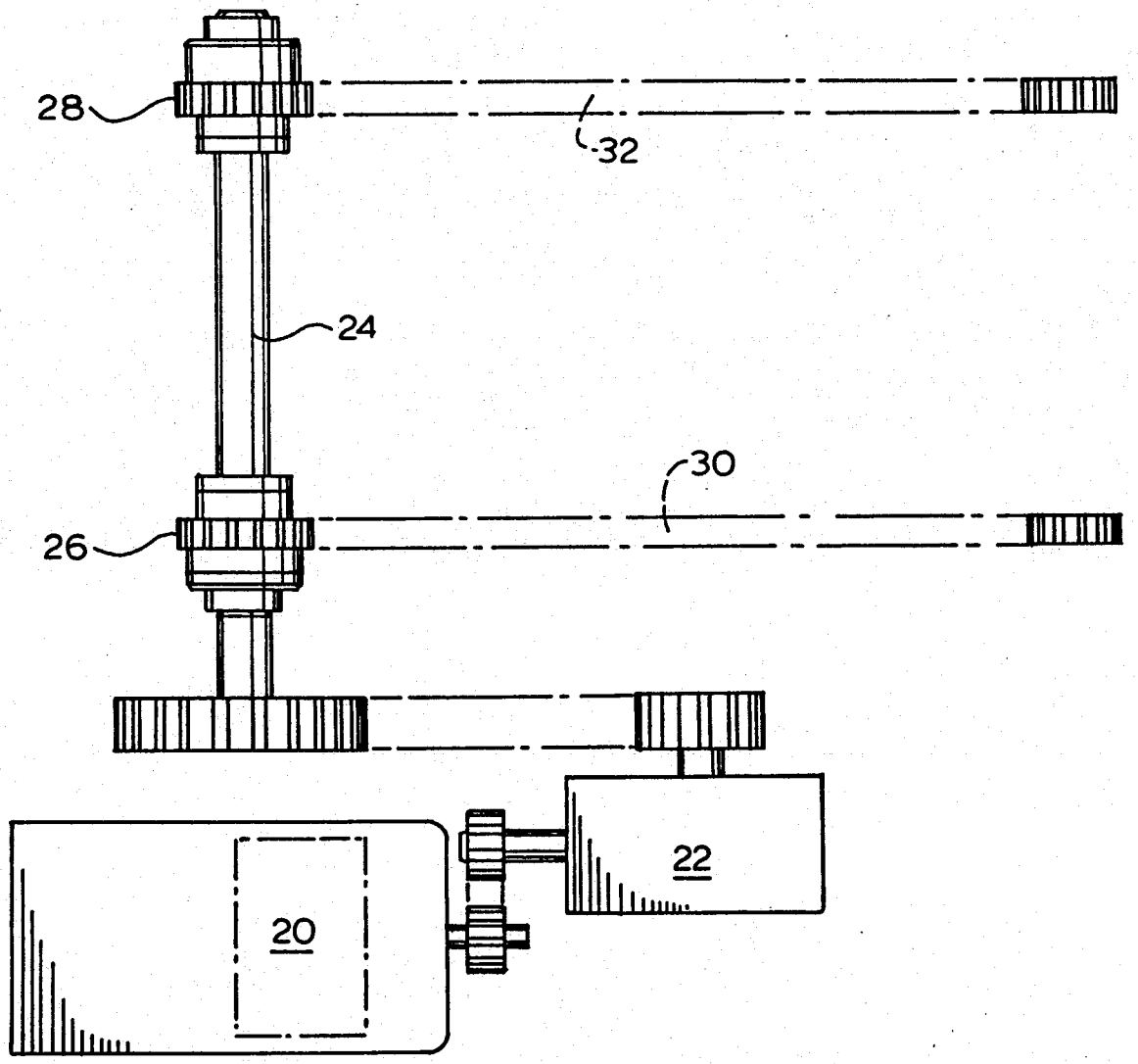
FIG. 3 is a top view of the apparatus of FIG. 1 with the roll and core supporting members removed.

Turning first to FIG. 1 there is shown a preferred embodiment of the roll loading apparatus of the present invention. Particularly, a roll of web material 10 having a core 12 is shown mounted in an operative position to feed a printing press (not shown) positioned above the roll. This roll is initially brought to the press on a dolly, and prior to the present invention the roll was lifted manually by the core, one end at a time, to place it into the mounting 14 for the press.

In accordance with the present invention, the core is mechanically engaged and lifted into the operative position (mounting 14) on the press by a dual chain conveyor. This conveyor is driven by an electric motor 20 via a power/transmission element 22. This transmission in turn operates a drive shaft 24 which spans the width of the press. Sprockets 26 and 28 fixed to the drive shaft synchronously drive conveyor chains 30 and 32. This conveyor mechanism is operative in forward and reverse by well known switch means for controlling the rotational direction of the electric motor.

As shown in FIG. 1, chains 30 and 32 are each mounted to present a span having a triangular configuration. Particularly, chain 30 wraps around sprockets 34, 35 and 36 at its corners, with sprocket 36 positioned to create an acute angle with its vertex higher than the mounting position 14 of printing press. Chain 32 is similarly configured.

Primary supports 40 are cantilevered from the chains to engage the ends of the core. And secondary supports 42 serve to engage the core after the core is lifted over the vertex of the acute angle 44 formed by the chain. When the drive motor 20 is reversed, the secondary supports 42 engage the core of the roll to provide the requisite lift to move the core back over the vertex 44. Continuing in this direction to lower the roll, the weight of the roll is again shifted back to the primary supports 40 after the core passes the vertex.

From the foregoing description, it will be apparent that modifications can be made to the apparatus and method for using same without departing from the teachings of the present invention. Accordingly, the scope of the invention is only to be limited as necessitated by the accompanying claims.

I claim:

1. Conveyor apparatus for loading a roll of a web material having a core extending therefrom from a lower initial position to an upper operative position at the printer mount, said conveyor apparatus comprising:

dual chains driven by a common drive shaft, said drive shaft having chain engaging sprockets mounted thereto to cause synchronized motion of said dual chains;

selectively reversible electrical motor means connected to said drive shaft to provide selectively reversible movement of said drive shaft to thereby reverse the direction of motion of said dual chains;

core engaging primary supports cantilevered to said dual chains for carrying said core from said initial lower position to said upper operative position; and core engaging secondary supports cantilevered to said dual chains for lifting said core from said operative position when the direction of motion of said dual chains is reversed.

2. The conveyor apparatus for loading a roll of web material of claim 1 wherein said dual chains are configured to present an acute angle proximate said printer mount having its vertex above the elevation of said printer mount.

3. The conveyor apparatus for loading a roll of web material of claim 2 further comprising power transmission means intermediate said electrical motor means and said drive shaft.

4. The conveyor apparatus for loading a roll of web material of claim 1 further comprising power transmission means intermediate said electrical motor means and said drive shaft.

* * * * *